US006514059B1

(12) United States Patent
Takeuchi et al.

(10) Patent No.: US 6,514,059 B1
(45) Date of Patent: Feb. 4, 2003

(54) SCROLL COMPRESSOR

(75) Inventors: Makoto Takeuchi, Nagoya (JP); Shigeki Miura, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,573

(22) Filed: Jun. 7, 2000

(30) Foreign Application Priority Data

Jun. 8, 1999 (JP) ..... 11-161697

(51) Int. Cl.[7] ..... F03C 2/00

(52) U.S. Cl. ..... 418/55.3; 418/55.5; 418/57; 418/102; 464/102

(58) Field of Search ..... 418/55.3, 55.5, 418/57; 464/102

(56) References Cited

U.S. PATENT DOCUMENTS

| | | | | | |
|---|---|---|---|---|---|
| 4,522,574 | A | * | 6/1985 | Arai et al. | 418/55.3 |
| 4,552,518 | A | * | 11/1985 | Utter | 418/55.6 |
| 5,593,295 | A | | 1/1997 | Hill | |
| 6,113,371 | A | * | 9/2000 | Williams et al. | 418/55.3 |

FOREIGN PATENT DOCUMENTS

| | | | | | |
|---|---|---|---|---|---|
| FR | 2 559 846 | | | 8/1985 | |
| JP | 62-78494 | | | 4/1987 | |
| JP | 03-237283 | A | * | 10/1991 | 418/55.5 |
| JP | 04-036083 | A | * | 2/1992 | 418/55.5 |
| JP | 04-036085 | A | * | 2/1992 | 418/55.5 |
| JP | 4-234502 | | | 8/1992 | |
| JP | 05-149264 | A1 | * | 6/1993 | 418/55.3 |
| JP | 05-149265 | A1 | * | 6/1993 | 418/55.3 |
| JP | 8-261181 | | | 10/1996 | |
| JP | 10-153183 | | | 6/1998 | |
| JP | 11-241691 | A1 | * | 9/1999 | 418/55.3 |
| JP | 2000-064969 | A1 | * | 3/2000 | 418/55.3 |
| JP | 2000-249081 | A1 | * | 12/2000 | 418/55.3 |

OTHER PUBLICATIONS

U.S. patent application Ser. No. 09/588,573, filed Jun. 7, 2000, pending.
U.S. patent application Ser. No. 09/985,294, filed Nov. 2, 2001, pending.
U.S. patent application Ser. No. 09/985,493 filed Nov. 5, 2001, pending.
U.S. patent application Ser. No. 09/589,172, filed Jun. 8, 2000, pending.
U.S. patent application Ser. No. 09/588,707, filed Jun. 7, 2000, pending.
U.S. patent application Ser. No. 09/588,776, filed Jun. 7, 2000, pending.
U.S. patent application Ser. No. 09/588,731, filed Jun. 7, 2000, pending.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

An object of the present invention is to provide a scroll compressor that improves assembly precision and the engagement projections are not easily damaged even when a strong force is applied to the Oldham ring during operation; in order to attain this object, a scroll compressor is provided wherein a fixed scroll member comprising an end plate and an involute wrap provided on one face of the end plate, and an orbiting scroll member comprising an end plate and an involute wrap provided on one face of this end plate, and which form a plurality of compression chambers in combination with the involute wrap of the fixed scroll member, wherein a mechanism that prevents autorotation of this orbiting scroll memberand permits rotation of the orbiting scroll member with respect to fixed scroll member is provided between the orbiting scroll member and fixed scroll member.

12 Claims, 7 Drawing Sheets

SCROLL COMPRESSOR

BACKGROUND OF THE INVENTION

1. Field of the Invention

The present invention relates to a scroll compressor, and in particular to a scroll compressor suitable for a vapor compression refrigerating cycle that uses a refrigerant in the supercritical region of carbon dioxide ($CO_2$), for example.

2. Description of the Related Art

Recently, a refrigeration cycle using carbon dioxide (referred to hereinbelow as a "carbon dioxide cycle") as a working gas (refrigerant gas) has been proposed, for example, in Japanese Examined Patent Application, Second Publication, No. Hei 7-18602, as one measure for eliminating the use of Freon (dichlorofluoromethane) as a refrigerant in the vapor compression-type refrigerating cycle. This carbon dioxide cycle is identical to the conventional vapor compression-type refrigerating cycle that uses Freon. That is, as shown by A-B-C-D-A in FIG. 8, which shows a carbon dioxide Mollier chart, the carbon dioxide in the gaseous phase is compressed by a compressor (A-B), and this gas-phase carbon dioxide that has been compressed to a high temperature is cooled in a radiator, such as a gas cooler (B-C). Next, the carbon dioxide is decompressed using a decompressor (C-D), the carbon dioxide that has changed to a liquid phase is vaporized (D-A), and an external fluid such as air is cooled by removing its latent heat of vaporization.

However, the critical temperature of carbon dioxide is about 31°, which is low compared to the critical temperature of Freon, the conventional refrigerant. When the external temperature is high, during summer, for example, the temperature of carbon dioxide on the radiator side is higher than its critical temperature. This means that the carbon dioxide does not condense at the radiator outlet side. In FIG. 8, this is shown by the fact that the line BC does not cross the saturated liquid line SL. In addition, the state on the radiator output side (point C) is determined by the discharge pressure of the compressor and the temperature of the carbon dioxide at the radiator outlet side. Moreover, the temperature of the carbon dioxide at the radiator outlet side is determined by the radiating capacity of the radiator and the temperature of the uncontrollable external air. Due to this, the temperature at the radiator outlet cannot be substantially controlled. Therefore, the state of the radiator outlet side (point C) can be controlled by the discharge pressure of the compressor, that is, the pressure on the radiator outlet side. This means that in order to guarantee sufficient refrigerating capacity (difference in enthalpy) when the temperature of the external air is high, during summer, for example, as shown by E-F-G-H-E, the pressure on the radiator output side must be high. In order to attain this, the operating pressure of the compressor must be high in comparison to the refrigeration cycle used with conventional Freon. In the case of an air conditioning device for an automobile, for example, the operating pressure of the compressor when using Freon (Trademark R134) is about 3 kg/cm$^2$, while in contrast, this pressure must be raised to about 40 kg/cm$^2$ for carbon dioxide. In addition, the operation stopping pressure when using Freon (Trademark R134) is about 15 kg/cm$^2$, while in contrast it must be raised to about 100 kg/cm$^2$ for carbon dioxide.

Below, for example, a common scroll compressor disclosed in Japanese Unexamined Patent Application, First Publication, No. Hei 4-234502, will be explained using FIG. 9. As shown in FIG. 9, in the casing 100, a fixed scroll member 101, an orbiting scroll member 102, and an Oldham ring 105, which is an anti-rotation device, are provided.

The fixed scroll member 101 is formed by a fixed side end plate 101*a*, an involute wrap 101*b* provided on one face of this fixed side end plate 101*a*, and a discharge port 104 provided approximately at the center part of this fixed end plate 101*a*. The orbiting scroll member 102 is formed by an orbiting side end plate 102*a* and an involute wrap 102*b* provided on one face of the orbiting side end plate 102*a*. This orbiting scroll member 102 is driven so as to revolve eccentrically with respect to the fixed scroll member 101. The orbiting scroll member 102 relatively rotating with respect to the fixed scroll member 101 forms an involute pressure chamber 103 between the involute wrap 102*b* of the orbiting scroll member 102 and the involute wrap 101*b* of the fixed scroll member 101. The Oldham ring 105 allows rotation of the orbiting scroll member 102 with respect to the fixed scroll member 101 while preventing autorotation of the orbiting scroll member 102. Furthermore, by adjusting the precision of the Oldham ring 105, the phase of the orbiting scroll member 102 and the fixed scroll member 101 can be adjusted.

However, in this conventional scroll compressor, the Oldham ring 105 is provided on the backside of the orbiting scroll member 102. Due to this, the position of the orbiting scroll member 102 is easily displaced with respect to the fixed scroll member 101, the phases of orbiting scroll member 102 and the fixed scroll member 101 easily shift, resulting in the problems that the assembly precision and the reliability are low.

In addition, for example, in a scroll compressor using carbon dioxide as the working gas and having a high operating pressure, when using an Oldham ring 105 having a long connection wrap 106, which is the part in contact with the fixed scroll member 101, an excessive load is applied to the base of the engagement projection 106, which causes fatigue damage, and thus, there is a concern that thereby the reliability will deteriorate.

In consideration of the above described problems with conventional technology, it is an object of the present invention to provide a scroll compressor that increases the assembly precision of the orbiting scroll member and the fixed scroll member, whose engagement projection is difficult to damage even when a large force is applied to the Oldham joint during operation, and therefore, has a high reliability.

SUMMARY OF THE INVENTION

According to a first aspect of the present invention, the present invention provides a scroll compressor furnished with a fixed scroll member including a first end plate and a first involute wrap provided on one face of the first end plate, the fixed scroll being movably supported in the axial direction of the fixed scroll member, and an orbiting scroll member including a second end plate and a second involute wrap provided on one face of the second end plate, which form a plurality of compression chambers in combination with the first involute wrap of the fixed scroll member, wherein a mechanism that prevents rotation of the orbiting scroll member with respect to the fixed scroll member is provided between the orbiting scroll member and the fixed scroll member.

The present invention also provides a scroll compressor including: a fixed scroll member comprising a first end plate and a first involute wrap provided on one face of the first end plate; a flat spring member disposed so as to support the fixed scroll member, the flat spring member allowing the fixed scroll member to move in the axial direction of the fixed scroll member; and an orbiting scroll member comprising a second end plate and a second involute wrap provided on one face of the second end plate, and which form a plurality of compression chambers in combination with the first involute wrap of the fixed scroll member, wherein a mechanism that prevents rotation of the orbiting scroll member with respect to the fixed scroll member is provided between the orbiting scroll member and the fixed scroll member.

According to this scroll compressor, because the mechanism that prevents the rotation of the orbiting scroll member with respect to the fixed scroll member is provided between the fixed scroll member and the orbiting scroll member, and the fixed scroll member is movably supported in the axial direction thereof, by placing the fixed scroll member and the orbiting scroll member each on the Oldham ring, the meshing of the fixed scroll member and the orbiting scroll member can be carried out with high precision. Also, the axial dimensions of the apparatus comprising the fixed scroll member, the orbiting scroll member, and the abovedescribed mechanism may be reduced in size.

In particular, a pair of first grooves are formed on the first end plate of the fixed scroll member and a pair of second grooves is formed on the second end plate of the orbiting scroll member, and the above-described mechanism is an Oldham ring comprising an annular body disposed rotatably between the fixed scroll member and the orbiting scroll member; first engaging projections that are provided on one end face of the annular body facing the fixed scroll member, the first engaging projections being engaged with the pair of the first grooves so as to prevent the rotation of the fixed scroll member with respect to the orbiting scroll member; and second engaging projections that are provided on the other end face of the annular body facing the orbiting scroll member, the second engaging projections being engaged with the pair of the second grooves so as to prevent the rotation of the orbiting scroll member with respect to the fixed scroll member.

In addition, the length of the first and second engaging projections formed on the Oldham ring are preferably substantially equal because then damage to the engaging projections due to fatigue will not occur easily even in the case that a large load is applied to the base of the engaging projections, as in a scroll compressor having a high operating pressure and using carbon dioxide as the working gas.

In addition, a concave part is preferably formed on a surface of the fixed scroll member and/or the orbiting scroll member facing the annular body, the concave part being used for embedding the annular body. This is because the axial dimensions of the apparatus comprising the fixed scroll member, the orbiting scroll member, and the above-described mechanism are then reduced in size.

DESCRIPTION OF THE PREFERRED EMBODIMENTS

Figure 1:
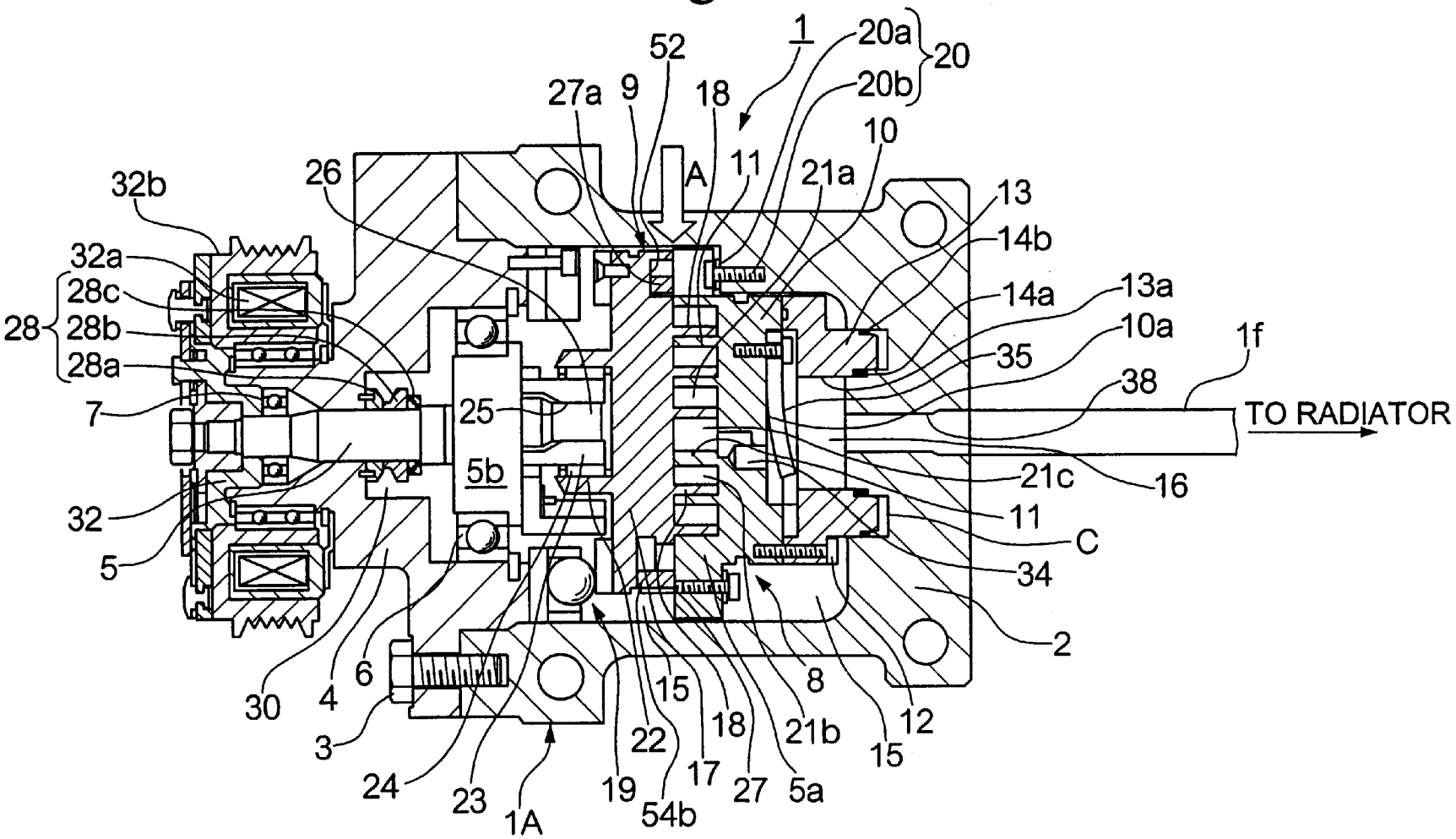
FIG. 1 is a longitudinal section drawing showing the embodiment of the scroll compressor according to the present invention.

Next, an embodiment of the scroll compressor of the present invention will be explained referring to the drawings.

Figure 7:
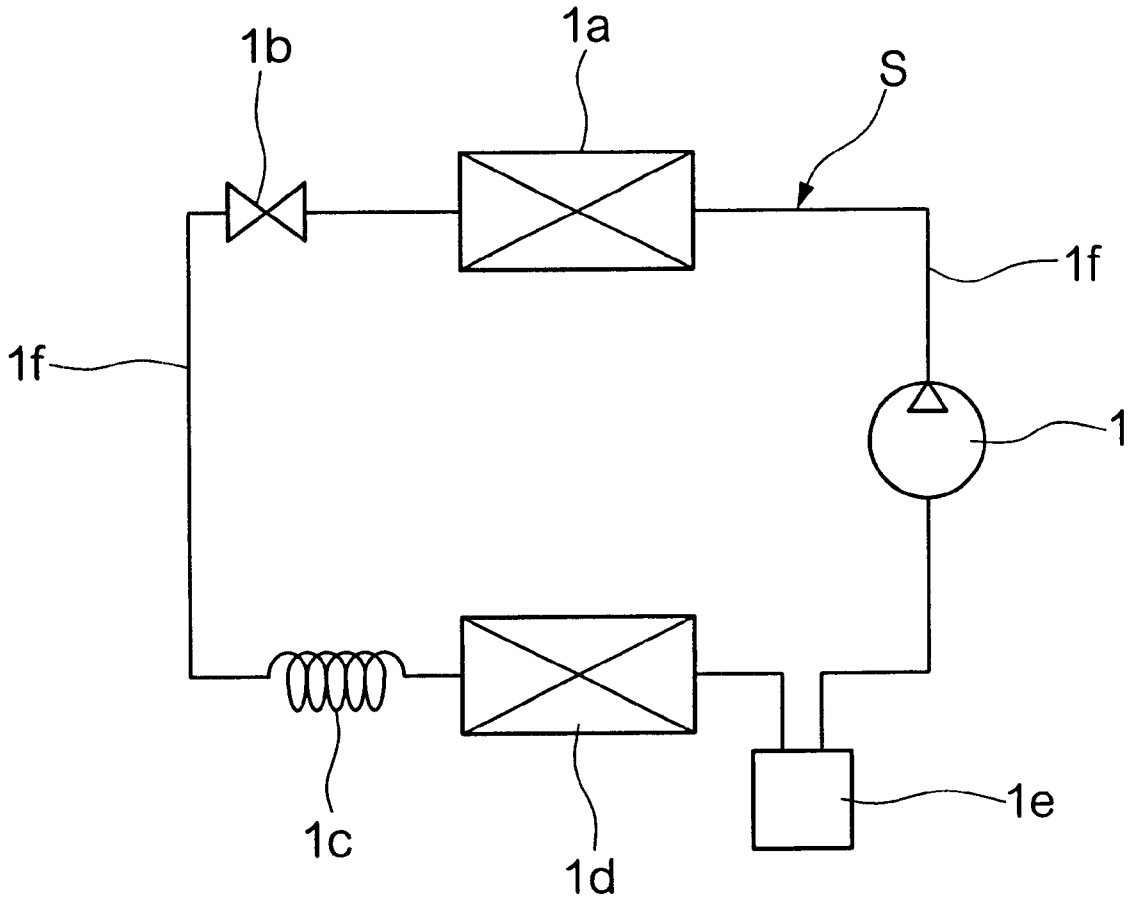
FIG. 7 is a schematic drawing showing the vapor compression-type refrigeration cycle.
Figure 8:
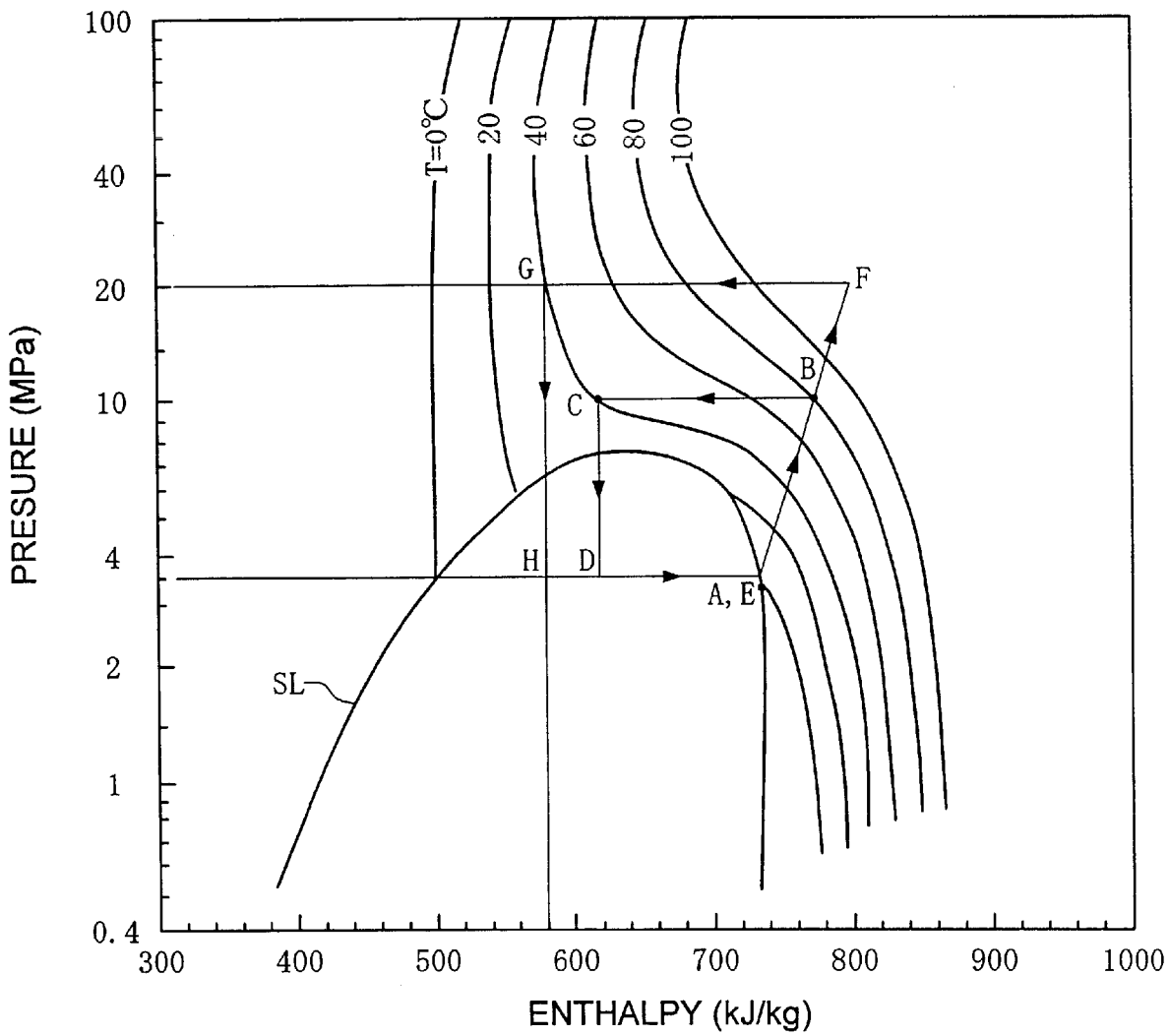
Fig. 8 PRIOR ART
FIG. 8 is a Mollier chart for carbon dioxide.
Figure 9:
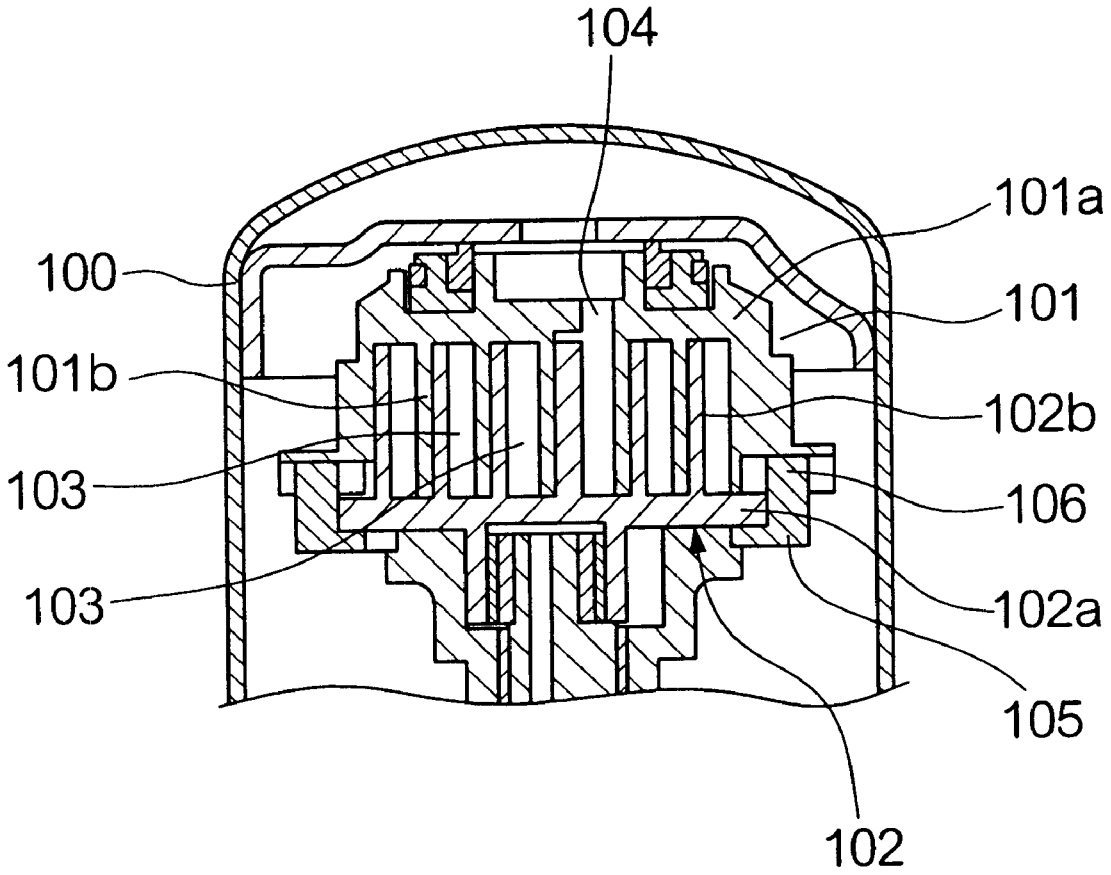
Fig. 9 PRIOR ART
FIG. 9 is a cross-sectional drawing showing the essential elements of a conventional scroll compressor.

First, please refer to FIG. 7 for the carbon dioxide cycle for the scroll compressor of the present invention. The carbon dioxide cycles shown in FIG. 7 applies, for example, to an air-conditioning system for an automobile.

In FIG. 7, reference numeral 1 denotes the scroll compressor that compresses carbon dioxide that is in a gaseous state. The scroll compressor 1 is driven by receiving drive power from a drive source such as an engine (not illustrated). Reference numeral 1*a* denotes a radiator such as a gas cooler that cools the carbon dioxide that has been compressed by the scroll compressor 1 by heat exchange with the external air. Reference numeral 1*b* denotes a pressure control valve that controls the pressure of the radiator 1*a* outlet side according to the temperature of the carbon dioxide on the radiator 1*a* outlet side. Reference numeral 1*c* is a metering device. The carbon dioxide is decompressed by the pressure control valve 1*b* and the metering device 1*c,* and the carbon dioxide changes to a gas-liquid two-phase state at low temperature and low pressure. Reference numeral 1*d* shows a vaporizer such as a heat sink that serves as an air-cooling mechanism in an automobile cabin. When the liquid-gas two-phase carbon dioxide at low temperature and low pressure is vaporized, that is, evaporated, in the vaporizer, the air in the automobile cabin is cooled by removing the latent heat of vaporization from the air in the automobile cabin. Reference numeral 1*e* denotes an accumulator that temporarily accumulates the gas-phase carbon dioxide. The scroll compressor 1, the radiator 1*a,* the pressure control valve 1*b,* the metering device 1*c,* the vaporizer 1*d,* and the accumulator 1*e* are respectively connected by conduit 1*f* to form a closed system.

Next, a preferred embodiment of the above-described scroll compressor will be explained referring to FIG. 1. The housing (casing) 1A of the scroll compressor 1 is formed by a cup-shaped case body 2 and a front case (crankshaft case) 4 fastened thereto by a bolt 3. The crankshaft 5 passes through the front case 4, and is supported freely-rotatably in the front case 4 via a main bearing 6 and a sub-bearing 7. The revolution of the automobile engine (not illustrated) is transmitted via a well-known electromagnetic clutch 32 to the crankshaft 5. Moreover, reference numerals 32*a* and 32*b* respectively denote the coil and pulley of the electromagnetic clutch 32.

Inside the housing 1A, the orbiting scroll member 9 and the fixed scroll member 8 are disposed.

The orbiting scroll member 9 has an end plate 17 and an involute wrap 18 projecting from the inner face thereof. The involute wrap 18 has a shape substantially identical to the involute wrap 11 of the fixed scroll member 8.

The fixed scroll member 8 has an end plate 10 and an involute wrap 11 projecting from the face thereof. On the back face of the end plate 10, the back-pressure block 13 is removably anchored by a bolt 12. The inner peripheral face and the outer peripheral face of the back-pressure block 13 respectively have embedded O-rings 14*a* and 14*b*. These O-rings 14*a* and 14*b* are in intimate contact with the inner peripheral faces of the case body 2. Thereby, the low pressure chamber (suction chamber) 15 and the high pressure chamber (discharge chamber) 16 described below in the case body 2 are separated. The high pressure chamber 16 is formed from the inner space 13*a* of the back-pressure block 13 and the concave part 10*a* formed on the back face of the end plate 10 of the fixed scroll member 8.

A ring shaped flat spring 20*a* is disposed between the fixed scroll member 8 and the case body 2. This flat spring 20*a* is fastened alternately to the fixed scroll member 8 and the case body 2 in the peripheral direction via a plurality of bolts 20*b*. Thereby, the fixed scroll member 8 is allowed to move only in its axial direction by the maximum radial amount of the flat spring 20*a*. This means that there is a floating structure. Moreover, the fixed scroll member supporting device 20 is formed by the ring-shaped flat spring 20*a* and the bolts 20*b*.

In addition, the back-pressure block 13 can move in the axial direction because of the gap provided between the back face projection of this back-pressure block 13 and the housing 1A.

The fixed scroll member 8 and the orbiting scroll member 9 are mutually eccentric by the radius of the revolving orbit, and are offset by a phase of 180°, and mesh as shown in FIG. 1. Moreover, the eccentricity of the fixed scroll member 8 and the orbiting scroll member 9 is denoted by reference symbol ρ in FIG. 2.

A tip seal (not illustrated) embedded in the end of the involute warp 11 of the fixed scroll member 8 is in intimate contact with the inner face of the end plate 17 of the orbiting scroll member 9. In addition, the tip seal (not illustrated) embedded in the end of the involute wrap 18 of the orbiting scroll member 9 is in intimate contact with the inner face of the end plate 10 of the fixed scroll member 8. Furthermore, the side faces of each involute wrap 11 and 18 are in intimate mutual contact at a plurality of locations. Thereby, a plurality of sealed spaces 21*a* and 21*b* are formed that are substantially point symmetrical with respect to the center of the involute shape.

An Oldham ring 27 that prevents autorotation and allows revolution of the orbiting scroll member 9 is provided between the fixed scroll member 8 and the orbiting scroll member 9. This Oldham ring 27 is a mechanism that prevents autorotation of the orbiting scroll member 9 (a mechanism for preventing relative rotation of the orbiting scroll member 9 and the fixed scroll member 8), and will be described in detail below.

At the center of the outer face of the end plate 17 of the orbiting scroll member 9, a circular boss 22 is formed. At the inside of this boss 22, a drive bush 23 is accommodated freely rotatably via the orbiting bearing 24 (drive bearing), which also acts as a radial bearing. Furthermore, in a through hole 25 formed in the drive bush 23, an eccentric axle 26 protruding from the inside end of the crankshaft 5 is engaged freely rotatably. In addition, between the external peripheral edge of the outer face of the end plate 17 of the orbiting scroll member 9 and the front case 4, a thrust ball bearing 19 for supporting the orbiting scroll member 9 is disposed.

On the external periphery of the crankshaft 5, a mechanical seal 28, which is a well-known shaft seal, is disposed. This mechanical seal 28 is formed from a sheet ring 28*a*, anchored in the front case 4, and a trailing ring 28*b* that rotates with the crankshaft 5. This trailing ring 28*b* is pressed against the sheet ring 28*a* by the urging member 28*c*. Thereby, the trailing ring 28*b* slides with respect to the sheet ring 28*a* along with the rotation of the crankshaft 5.

Below, the above-mentioned Oldham ring 27 will be explained.

Figure 2:
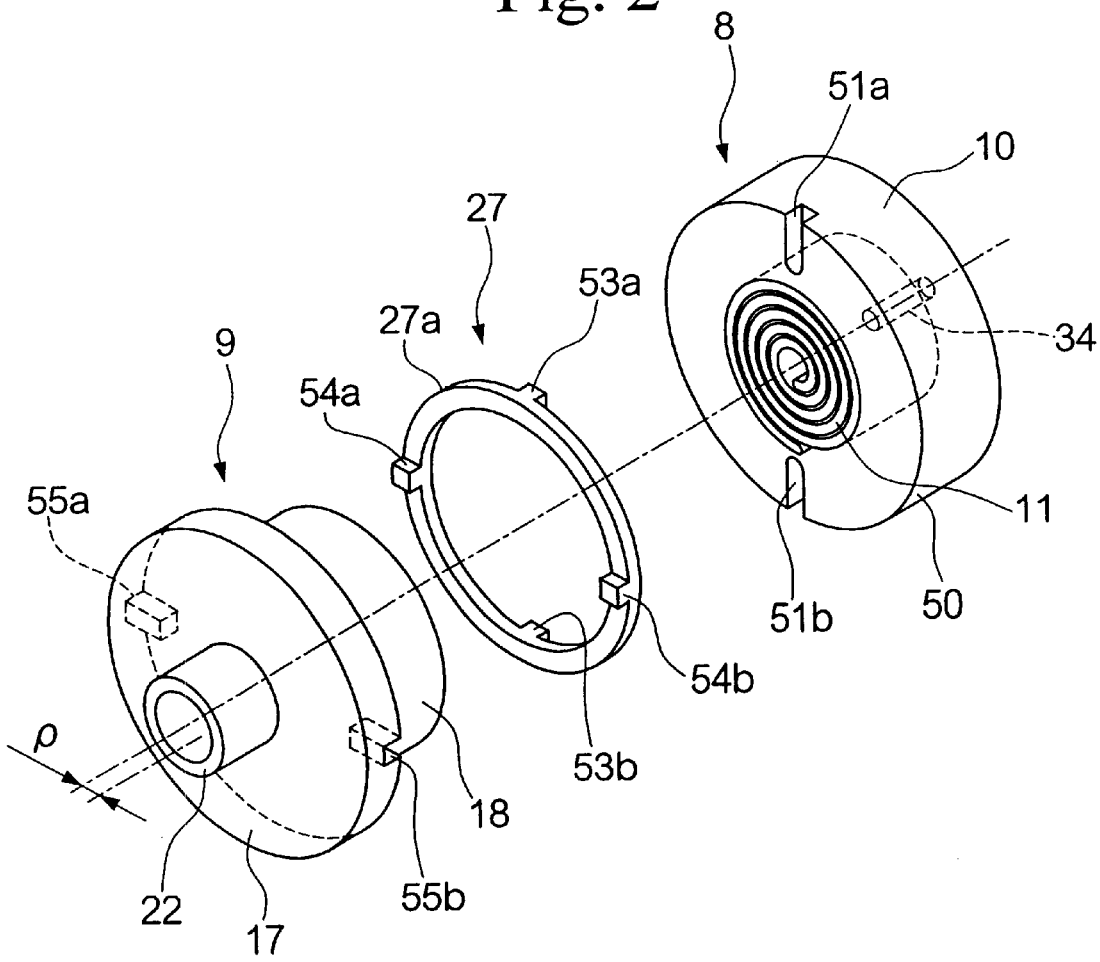
FIG. 2 is a perspective drawing showing the structure before assembly of the fixed scroll member, Oldham ring, and orbiting scroll member that are shown in FIG. 1.
Figure 3:
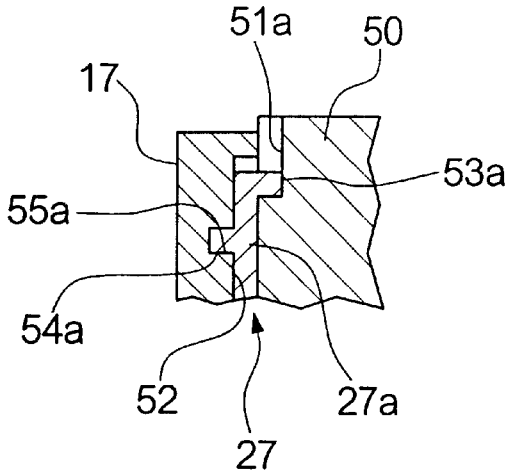
FIG. 3 is a cross-sectional drawing showing the engagement state of the fixed scroll member, the Oldham ring, and the orbiting scroll member after assembly, and cuts through the engaging portion in the peripheral direction.

As shown in FIG. 2 and FIG. 3, on the side face of the end plate 10 of the fixed scroll member 8, a wall part 50 is formed. Inside this wall part 50, the involute wrap 11 projecting from the inner face of the end plate 10 is accommodated. In addition, the end face of the wall part 50 faces so as to be in proximity with the end plate 17 of the orbiting scroll member 9. In addition, on the distal end face of the wall part 50, a pair of first guide grooves 51*a* and 51*b* are formed positioned on the diameter thereof. On the face provided on the orbiting scroll member 9 and facing the fixed scroll member 8 of the end plate 17, as shown in FIG. 3, a concave part 52 is formed so as to accommodate the circular body 27*a* of the Oldham ring 27. On the diameter of the bottom round face of this concave part 52, a pair of second guide grooves 55*a* and 55*b* are formed positioned on the diameter thereof. Moreover, the first guide grooves 51*a* and 51*b* can be formed on the end plate 17 of the orbiting scroll member 9, and the concave part 52 can be formed on the wall part 50 of the fixed scroll member 8.

The Oldham ring 27 is provided with a round body 27*a* disposed on the periphery of each of the involute wraps 11 and 18 so as to be able to orbit. On one end face of this circular body 27*a*, a pair of first engagement projections 53*a* and 53*b* is integrally formed on the end face positioned on the diameter thereof. This pair of first engagement projections 53*a* and 53*b* are engaged freely slidable having the play of the eccentricity ρ in the pair of first guide grooves 51*a* and 51*b* provided on the wall part 50 of the fixed scroll member 8. The first engagement projections 53*a* and 53*b* engage in the first guide grooves 51*a* and 51*b*, and thereby the fixed scroll member 8 cannot autorotate with respect to the circular body 27*a*. In addition, as shown in FIG. 2, by assembling the circular part 27*a* and the fixed scroll member 8 such that the center of the circular part 27*a* and the center of the wall part 50 can be displaced by ρ, the first engagement projections 53*a* and 53*b* provided on the circular body 27*a* can slide within the first guide grooves 51*a* and 51*b* provided on the wall part by the distance ρ.

On the other end face of the circular body 27*a*, a pair of second engagement projections 54*a* and 54*b* is formed positioned on the diameter thereof. Moreover, the second engagement projections 54*a* and 54*b* are disposed so as to be orthogonal to the diameter on which the above first engagement projections 53*a* and 53*b* are arranged. This pair of second engagement projections 54*a* and 54*b* are engaged freely slidably having the play of the eccentricity ρ in the pair of second guide grooves 55*a* and 55*b* provided on the end plate 17 of the orbiting scroll member 9. The second engagement projections 54*a* and 54*b* engage in the second guide grooves 55*a* and 55*b*, and thereby the orbiting scroll member 9 cannot autorotate with respect to the circular body 27*a*. In addition, as shown in FIG. 2, by assembling the circular part 27*a* and the orbiting scroll member 9 such that the center of the circular part 27*a* and the center of the end plate 17 are displaced by ρ, the second engagement projections 55*a* and 55*b* provided on the end plate 17 can slide within the second guide grooves 55*a* and 55*b* provided on the end plate 17 by the distance ρ.

Below, the operation of the scroll compressor 1 will be explained.

Current passes through the coil 32*a* of the electromagnetic clutch 32, and the rotation of the automobile engine is transmitted to the crankshaft 5. Then the rotation of the crankshaft 5 is transmitted to the orbiting scroll member 9 via the orbiting drive mechanism comprising the eccentric axle 26, and through hole 25, the drive bush 23, the orbiting bearing 24, and the boss 22. The orbiting scroll member 9 is prevented from autorotation by the Oldham ring 27, which is an anti-rotation device, and moves in orbital rotation on a circular orbit whose radius is the eccentricity ρ of the eccentric axle 26. Because the orbiting scroll member 9 and the fixed scroll member 8 are disposed eccentrically, the involute wraps 11 and 18 contact each other at a plurality of locations at which the vertical line extending the whole height of the involute wrap 11 of the fixed scroll member 8 is in contact with the vertical line extending the whole height of the involute wrap 18 of the orbiting scroll member 9. Thereby, a plurality of compression spaces 21*a* and 21*b* are formed. When the orbiting scroll member 9 orbits, the contacting locations gradually move toward the centers of the involute wraps 11 and 18. Thereby, as the orbiting scroll member 9 orbits, the compressed spaces 21*a* and 21*b* made by the contacting involute wraps 11 and 18 move towards the center of the involute wraps 11 and 18 while the volume of the compressed spaces 21*a* and 21*b* decreases. Accompanying the above, the working gas that flows to the intake chamber 15 through the intake opening (not illustrated) flows into the sealed space 21*a* from the outer terminal opening part (refer to arrow A in FIG. 1) between both of the involute wraps 11 and 18, and reaches the center part 21*c* while being compressed. From here, the working gas passes through the discharge port 34 formed in the end plate 10 of the fixed scroll member 8, pushes open the discharge valve 35, and is discharged from the high pressure chamber 16. Subsequently, the discharge gas flows out from the discharge opening 38. Thereby, the working gas that is a fluid introduced from the intake chamber 15 due to the orbiting of the orbiting scroll member 9 is compressed in the sealed spaces 21*a* and 21*b*, and the obtained pressurized gas is discharged. The current flowing to the coil 32*a* of the electromagnetic clutch 32 is cut, and when the transmission of the rotational force to the crankshaft 5 ceases, the motion of the open-type compressor 1 is stopped.

In the above-described scroll compressor 1, the Oldham ring 27 is provided between the fixed scroll member 8 and the orbiting scroll member 9. Thus, by equipping the fixed scroll member 8 and the orbiting scroll member 9 with an Oldham ring 27, the fixed scroll member 8 and the orbiting scroll member 9 can be disposed in an accurate phase due to the Oldham ring 27.

In addition, the length of the first engagement projections 53*a* and 53*b* and the second engagement projections 54*a* and 54*b* provided on the Oldham ring 27 are shortened, and preferably are substantially equal. In particular, in the case that a heavy load is applied to the base of the engagement projections 53*a*, 53*b*, 54*a*, and 54*b*, as in a scroll compressor having a high operating pressure using carbon dioxide as a working gas, by forming short engagement projections 53*a*, 53*b*, 54*a*, and 54*b*, fatigue damage, etc., thereof does not occur easily.

Below, another embodiment of the mechanism for preventing autorotation of the fixed scroll member 8 and the orbiting scroll member 9 will be explained referring to FIG. 4 to FIG. 6.

Figure 4:
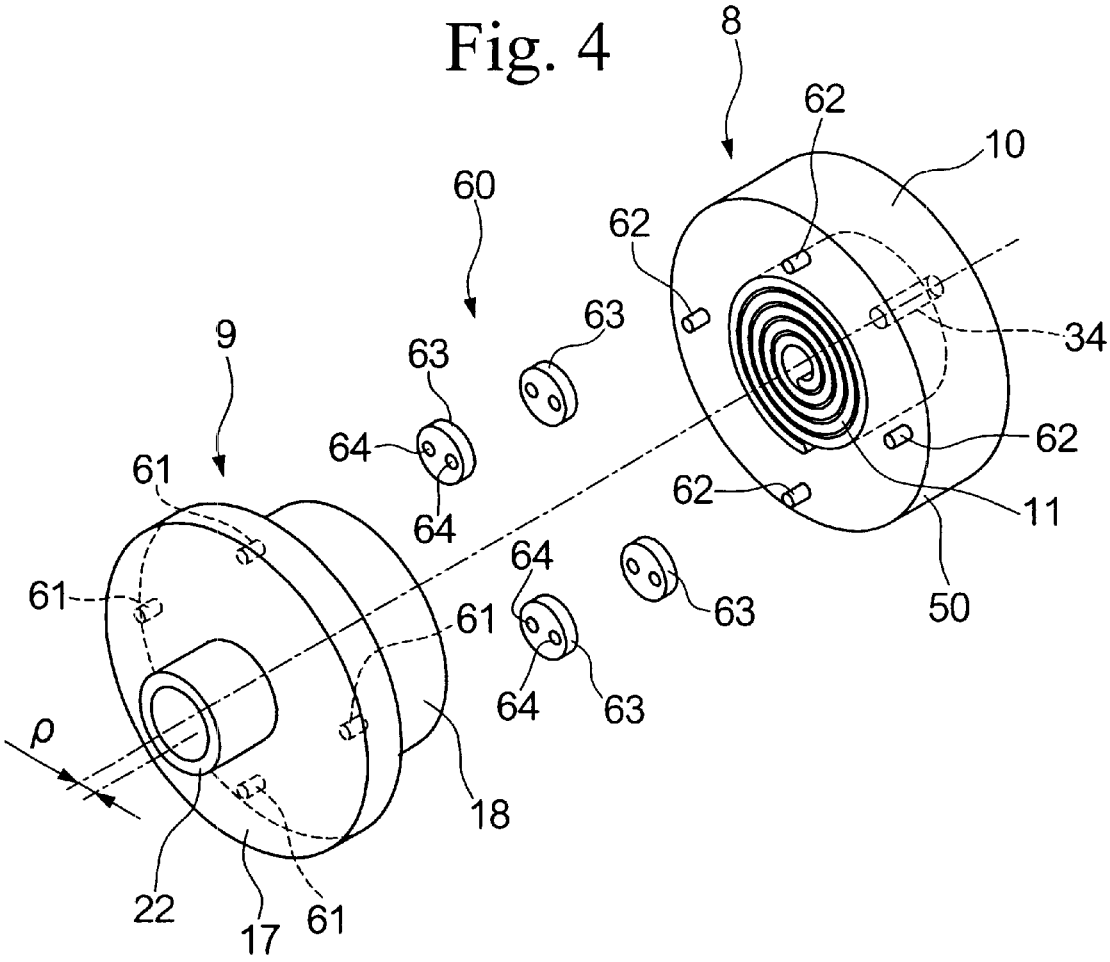
FIG. 4 is a perspective drawing showing the case when another form is substituted for the Oldham ring shown in FIG. 2.
Figure 5:
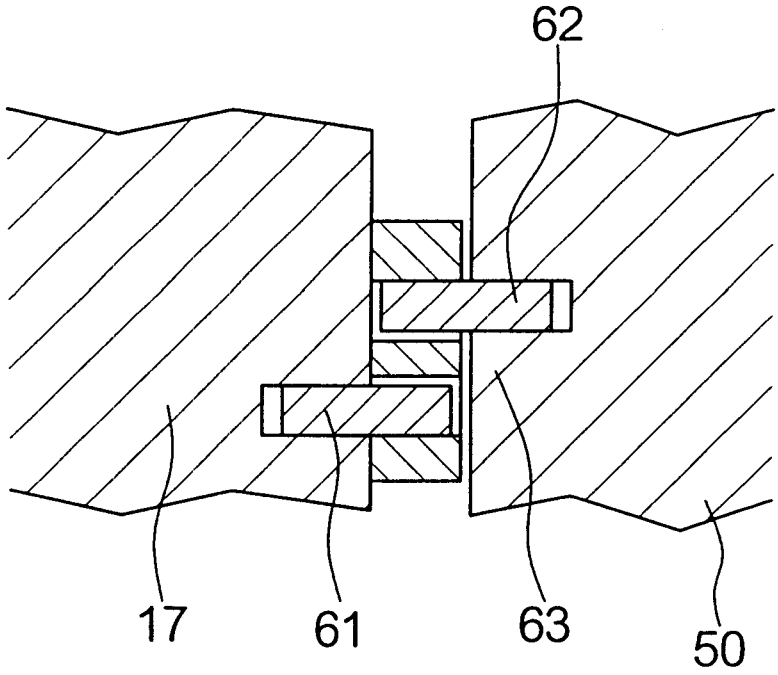
FIG. 5 is a cross-sectional drawing of the engagement portion in FIG. 4 after assembly.
Figure 6:
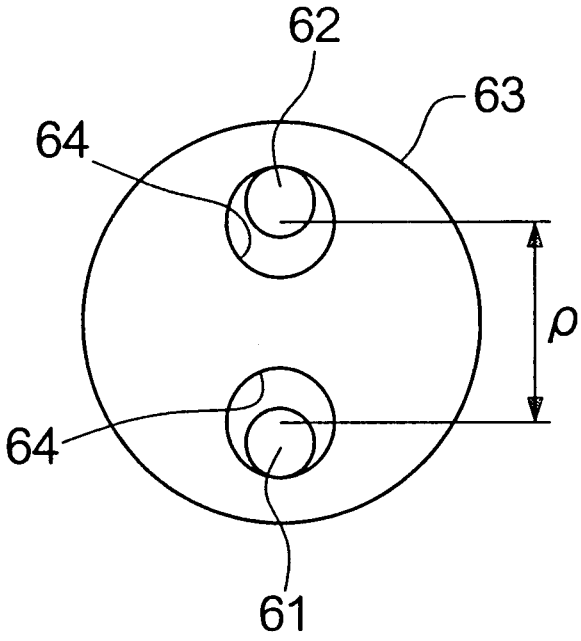
FIG. 6 is an expanded drawing of the wrap restraining member shown in FIG. 4 and FIG. 5.

The anti-rotation device 60 shown in FIG. 4 to FIG. 6 is disclosed in Japanese Patent Application, No. Hei 10-350262, by the present inventor. A plurality (in this example, four) of orbiting pins 61 spaced equally in the peripheral direction project on the face of the end plate 17 of the orbiting scroll member 9 facing the fixed scroll member 8. Moreover, additionally, on the distal end face (the face facing the end plate 17 of the orbiting scroll member 9) of the wall part 50 of the fixed scroll member 8 as well, fixed pins 62, having the same number as the orbiting pins 61, are equally spaced in the peripheral direction.

Reference numeral 64 denotes disk-shaped pin restraining members 63 provided between the end plate 17 of the orbiting scroll member 9 and the wall part 50 of the fixed scroll member 8. A pair of holes 64 are formed that engage the orbiting pins 61 and the fixed pins 62 by their individual play in these pin restraining members 63. That is, these holes 64 are formed sufficiently larger than the orbiting pins 61 and the fixed pins 62. In addition, distance ρ between the centers of one hole 64 and that of another hole 64 is equal to the eccentricity of the eccentric axle 26 (refer to FIG. 1). This eccentricity is equal to the orbiting radius of the orbiting scroll member 9. In the present embodiment, holes 64 are illustrated showing through holes. However, they need not be through holes, and a stop hole that is not opened at both end faces of the pin restraining member 63 can also be used.

In this embodiment, because the anti-rotation device 60 is provided between the fixed scroll member 8 and the orbiting scroll member 9, the assembly precision of the fixed scroll member 8 and the orbiting scroll member 9 is improved.

In addition, when the crankshaft 5 (refer to FIG. 1) is rotated, like the case with the Oldham ring shown in FIG. 2 and FIG. 3, the orbiting scroll member 9 revolves centered on the crankshaft 5 (refer to FIG. 1) having a radius equal to the eccentricity of the eccentric axle 26 via the orbiting drive mechanism comprising the drive bush 23, the orbiting axle 24, the boss 22, etc., (refer to FIG. 1) while autorotation of the orbiting scroll member 9 is prevented by the autorotation prevention mechanism. Thereby, the contact point between the involute wrap 11 and the involute wrap 18 gradually move towards the center of the wraps. As a result, the sealed spaces 21*a* and 21*b* move towards the center of the warps while decreasing in volume.

In the above-described embodiments, the open-type compressor was applied to a carbon dioxide cycle using carbon dioxide as the working gas, but the invention is not limited thereto, and it can also be adapted to a typical vapor pressure compression type refrigeration cycle using Freon, etc., as the working gas.

What is claimed is:

1. A scroll compressor comprising:

a housing;

a fixed scroll member comprising a first end plate, a first involute wrap provided on one face of said first end plate, and a wall part provided so as to surround said first involute wrap, said fixed scroll member being disposed in said housing;

an orbiting scroll member comprising a second end plate and a second involute wrap provided on one face of said second end plate, and which form a plurality of compression chambers in combination with said first involute wrap of said fixed scroll member, said orbiting scroll member being disposed in said housing;

a mechanism for preventing autorotation of said orbiting scroll member and for permitting rotation of said orbiting scroll member with respect to said fixed scroll member, said mechanism for preventing autorotation being provided between said orbiting scroll member and said fixed scroll member; and a floating structure mechanism that movably supports said fixed scroll member in the axial direction of said fixed scroll member, said floating structure mechanism being disposed between said housing and a side of said wall part of said fixed scroll member facing the opposite side of said orbiting scroll member, and a back-pressure block having a projection, which is disposed at a back portion of said first end plate, said back-pressure block being movable in an axial direction due to the presence of a gap between said projection of said back-pressure block and said housing, wherein said floating structure mechanism comprises a substantially flat spring member having a first end thereof which is connected to said housing and a second end thereof which is connected to said side of said wall part of said fixed scroll member such that a maximum axial amount of movement of the fixed scroll member is defined by said flat spring member and wherein said first and second ends of said flat spring member lie within substantially the same plane.

2. A scroll compressor according to claim 1, further comprising:

a pair of first grooves formed on said first end plate of said fixed scroll member; and a pair of second grooves formed on said second end plate of said orbiting scroll member; wherein said mechanism that prevents rotation of said orbiting scroll member with respect to said fixed scroll member comprises an Oldham ring comprising:

an annular body rotatably disposed between said fixed scroll member and said orbiting scroll member;

first engaging projections provided on a first end face of said annular body facing said fixed scroll member, said first engaging projections being engaged with the pair of said first grooves so as to prevent rotation of said fixed scroll member with respect to said orbiting scroll member; and second engaging projections provided on a second end face of said annular body facing said orbiting scroll member, said second engaging projections being engaged with the pair of said second grooves so as to prevent rotation of said orbiting scroll member with respect to said fixed scroll member.

3. A scroll compressor according to claim 2, wherein the length of said first engaging projections and the length of said second engaging projections of said Oldham ring are substantially the same.

4. A scroll compressor according to claim 3, further comprising:

a concave part formed on a surface of one of said fixed scroll member and said orbiting scroll member facing said annular body, said concave part being used for embedding said annular body.

5. A scroll compressor according to claim 2, further comprising:

a concave part formed on a surface of one of said fixed scroll member and said orbiting scroll member facing said annular body, said concave part being used for embedding said annular body.

6. A scroll compressor according to claim 1, wherein said scroll compressor is used for a refrigeration cycle using carbon dioxide as a working gas.

7. A scroll compressor comprising:

a housing;

fixed scroll means comprising a first end plate, a first involute wrap provided on one face of said first end plate, and a wall part provided so as to surround said first involute wrap, said fixed scroll means being disposed in said housing;

orbiting scroll means comprising a second end plate and a second involute wrap provided on one face of said second end plate, and which forms a plurality of compression chambers in combination with said involute wrap of said fixed scroll means, said orbiting scroll means being disposed in said housing;

means for preventing rotation of said orbiting scroll means with respect to said fixed scroll means provided between said orbiting scroll means and said fixed scroll means; and floating means for movably supporting said fixed scroll means in the axial direction of said fixed scroll means, said floating means being disposed between said housing and a side of said wall part of said fixed scroll means facing the opposite side of said orbiting scroll means, and a back-pressure block having a projection, which is disposed at a back portion of said first end plate, said back-pressure block being movable in an axial direction due to the presence of a gap between said projection of said back-pressure block and said housing, wherein said floating means comprises a substantially flat spring member having a first end thereof which is connected to said housing and at a second end thereof which is connected to said side of said wall part of said fixed scroll means such that a maximum axial amount of movement of the fixed scroll member is defined by said flat spring member and wherein said first and second ends of said flat spring member lies within substantially the same plane.

8. A scroll compressor according to claim 7, further comprising:

a pair of first grooves formed on said first end plate of said fixed scroll means; and a pair of second grooves formed on said end plate of said orbiting scroll means; wherein said means for preventing rotation of said orbiting scroll means with respect to said fixed scroll means comprises an Oldham ring comprising:

an annular body rotatably disposed between said fixed scroll means and said orbiting scroll means;

first engaging projections provided on a first end face of said annular body facing said fixed scroll means, said first engaging projections being engaged with the pair of said first grooves so as to prevent rotation of said fixed scroll means with respect to said orbiting scroll means; and second engaging projections provided on a second end face of said annular body facing said orbiting scroll means, said second engaging projections being engaged with said pair of said second grooves so as to prevent rotation of said orbiting scroll means with respect to said fixed scroll means.

9. A scroll compressor according to claim 8, wherein the length of said first engaging projections and the length of said second engaging projections of said Oldham ring are substantially the same.

10. A scroll compressor according to claim 9, further comprising:

a concave part formed on a surface of one of said fixed scroll means and said orbiting scroll means facing said annular body, said concave part being used for embedding said annular body.

11. A scroll compressor according to claim 8, further comprising:

a concave part formed on a surface of one of said fixed scroll means and said orbiting scroll means facing said annular body, said concave part being used for embedding said annular body.

12. A scroll compressor according to claim 7, wherein said scroll compressor is used for a refrigeration cycle using carbon dioxide as a working gas.

* * * * *